US005826450A

United States Patent [19]

Lerchner et al.

[11] Patent Number: 5,826,450

[45] Date of Patent: Oct. 27, 1998

[54] LOCKING DEVICE

[75] Inventors: Leonhard Lerchner, Salzburg, Austria; Hermann Hainzlmaier, Geisenfeld, Germany

[73] Assignee: Codatex ID-Systeme Gessellschaft mbH, St. Leonard, Austria

[21] Appl. No.: 646,472

[22] Filed: May 8, 1996

[30] Foreign Application Priority Data

May 15, 1995 [DE] Germany ..... 195 17 728.2

[51] Int. Cl.[6] ..... E05B 49/00

[52] U.S. Cl. ..... 70/278; 70/277; 70/283

[58] Field of Search ..... 70/278, 277, 279, 70/283

[56] References Cited

U.S. PATENT DOCUMENTS

| | | | |
|---|---|---|---|
| 3,473,355 | 10/1969 | Saito | 70/339 |
| 3,520,161 | 7/1970 | Jacobi | 70/372 |
| 3,639,906 | 2/1972 | Tritsch | 340/149 |
| 3,777,520 | 12/1973 | Crepinsek | 70/358 |
| 3,984,136 | 10/1976 | Bills | 292/182 |
| 4,232,353 | 11/1980 | Mosciatti et al. | 361/172 |
| 4,280,163 | 7/1981 | Osborne | 361/172 |
| 4,343,166 | 8/1982 | Hofmann | 70/358 |
| 4,612,787 | 9/1986 | Prunbauer et al. | 70/358 |
| 4,771,620 | 9/1988 | Kleinhany | 70/277 |
| 4,789,859 | 12/1988 | Clarkson et al. | 340/825.31 |
| 4,798,068 | 1/1989 | Nakauchi | 70/276 |
| 4,807,454 | 2/1989 | Sengupta et al. . | |
| 4,848,115 | 7/1989 | Clarkson et al. | 70/276 |
| 4,895,009 | 1/1990 | Kleefeldt et al. | 70/264 |
| 4,898,010 | 2/1990 | Futami et al. | 70/278 |
| 4,939,915 | 7/1990 | Vonlanthen | 70/277 |
| 5,010,750 | 4/1991 | Böser et al. . | |
| 5,117,097 | 5/1992 | Kimura et al. | 235/439 |
| 5,131,249 | 7/1992 | Baden et al. | 70/398 |
| 5,307,658 | 5/1994 | Kokubu et al. | 70/427 |
| 5,349,830 | 9/1994 | Keller | 70/358 |
| 5,351,042 | 9/1994 | Aston | 340/825.31 |
| 5,373,718 | 12/1994 | Schwerdt et al. | 70/278 |
| 5,469,727 | 11/1995 | Spahn et al. | 70/278 |
| 5,485,735 | 1/1996 | Laabs et al. | 70/358 |
| 5,507,162 | 4/1996 | Chhatwal | 70/278 |
| 5,531,084 | 7/1996 | Laabs et al. | 70/409 |
| 5,542,274 | 8/1996 | Thordmark et al. | 70/495 |
| 5,561,331 | 10/1996 | Suyama et al. | 307/10.3 |

FOREIGN PATENT DOCUMENTS

| | | | |
|---|---|---|---|
| 0187363B1 | 7/1988 | European Pat. Off. . | |
| 0401647A1 | 12/1990 | European Pat. Off. . | |
| 3517858A1 | 11/1985 | Germany . | |
| 3707201A1 | 9/1988 | Germany . | |
| 3806469A1 | 9/1989 | Germany . | |
| 3902992C1 | 3/1990 | Germany . | |
| 4234323A1 | 4/1994 | Germany . | |
| 43 36 476 | 4/1995 | Germany . | |
| 2273128 | 1/1994 | United Kingdom . | |
| 86/00108 | 1/1986 | WIPO | 70/278 |
| 87/02737 | 5/1987 | WIPO | 70/278 |
| WO 93/19267 | 9/1993 | WIPO . | |

*Primary Examiner*—Steven N. Meyers
*Assistant Examiner*—Tuyet-Phuong Pham
*Attorney, Agent, or Firm*—Flynn, Thiel, Boutell & Tanis, P.C.

[57] ABSTRACT

A locking device with at least one key and a locking cylinder having at least one cylinder core with a key channel. The core is mounted rotatably in a cylinder housing, mechanical tumblers for blocking and releasing the cylinder. An actuator is disposed in the cylinder housing for shifting a blocking element blocking and releasing the cylinder core. An electronic code transmitter is provided in the key and an electronic code evaluator in the cylinder housing for controlling the actuator. The electronic code transmitter is formed by a transponder (26) and the electronic code evaluator by a transponder reading device (16, 17). A power supply device (24) is disposed in the cylinder housing (1). The blocking element (23) engages in at least one recess (42, 43) disposed on the periphery of the cylinder core (4) spaced from the key channel (10, 11) in the axial area of the cylinder core (4) which is provided with the mechanical tumblers (49, 50, 51).

30 Claims, 2 Drawing Sheets

LOCKING DEVICE

FIELD OF THE INVENTION

This invention relates to a locking device.

BACKGROUND OF THE INVENTION

A locking device is known from EP 0 401 647 A1. The locking cylinder of the known locking device has the usual size and shape. An existing lock can thus be retrofitted to the known locking device merely by replacing the locking cylinder.

In the known locking device the power supply unit is provided in the key. The actuator is formed by an electromagnet which operates a latch which releases a blocking element displaceable in the axial direction, spring-loaded in the release position and disposed at the end of the key channel. Power is supplied to the electromagnet via a contact on the key tip. The known locking device has the disadvantage that the blocking element is easily accessible via the key channel so that the lock can be easily forced open. Apart from that the keys have a clumsy, unwieldy form due to the battery. Furthermore, if there are a multitude of keys for a lock the known locking device is costly due to the corresponding number of batteries.

DE 35 17 858 A1 and EP 0 187 363 B1 disclose locking devices wherein the electronic code transmitter is formed by a transponder in the key. The transponder reading device is mounted on the door in the lock outside the locking cylinder. When this known locking device is installed in existing objects the door must thus be altered and the entire lock, i.e. not just the locking cylinder, replaced.

SUMMARY OF THE INVENTION

The object of the invention is to provide a locking device difficult to open by force of which can be installed merely by replacing the locking cylinder of an existing cylinder lock by a new locking cylinder.

In the inventive locking device a transponder is used as an electronic code transmitter and a transponder reading device as a code evaluator. That is, two mutually coordinated electric high-frequency oscillating circuits (radiofrequency) are provided in the key and locking cylinder.

When the key approaches the oscillating circuit of the locking cylinder there is excitation in the oscillating circuit of the key and thus a power supply which permits data transmission from the key to the transponder reading device.

Data transmission thus takes place without contact, thereby avoiding problems with transfer contacts, such as soiling, attrition and deformation.

Since the code transmitter or data carrier is passive one can use a flat key with a bow of usual size. The inventive locking device also manages with only one power supply unit in the cylinder housing, regardless of the number of keys authorized for the locking device.

The transponder reading device, the actuator and the power supply unit are disposed within the cylinder housing according to the invention. One can therefore mount the inventive locking device in existing objects merely by replacing the locking cylinder without altering the door and without replacing lock and armature.

According to the invention the blocking element operated by the actuator acts upon the peripheral surface of the cylinder core, the key channel being open laterally toward the peripheral surface of the cylinder core, i.e. spaced from the lateral opening thereof. The blocking element is therefore inaccessible via the key channel so that the lock cannot be opened by force via the key channel, at least not without difficulty.

The blocking element preferably engages in a recess in the peripheral surface of the cylinder core. It is preferably spring-loaded into its blocked position. The force for moving the blocking element into the blocked position, i.e. into the recess, is thus applied by the spring. The blocking element is moved out of the recess in the peripheral surface of the cylinder core, i.e. the cylinder core released, by manual force during turning of the key inserted in the cylinder core.

To facilitate this moving out, a roll body is preferably mounted rotatably on the blocking element for engaging in the recess. The roll body can be for example a ball, but it is preferably formed by a roll which engages in a corresponding longitudinal groove on the periphery of the cylinder core.

In the blocked position of the blocking element the roll thus opposes a forcible turning of the cylinder core by a high shear force. It further rolls over the bores in the cylinder core in which the tumbler pins are disposed, if the key has mechanical coding as well as the electronic coding, as explained more closely in the following, i.e. if tumblers are provided in the locking cylinder which scan the key provided with depressions.

The actuator can be for example a relay. However it is preferably formed by an electric motor on whose shaft an eccentric with two diametrically opposed cams is seated for shifting the blocking element radially displaceable in the cylinder housing into the blocked position or release position.

In the blocked position of the blocking element the two cams are supported on the blocking element and the cylinder housing. To release the cylinder core the eccentric is turned out of the blocked position through approx. 90° by the motor. The actuator thus has two stable positions.

The motor is designed to be freely rotating. That is, it need apply no force to shift the blocking element. This is because the blocking element is shifted into the blocked position by the spring load thereof into the blocked position, while the force for shifting the blocking element into the release position is applied manually during turning of the cylinder core, as mentioned above.

The motor can therefore be very small and thus be housed in the cylinder housing in space-saving fashion. Its energy consumption is also very low.

If the cylinder core has a key channel which is open toward the peripheral surface of the cylinder core, the blocking element is preferably formed as a stirrup which engages with its two ends in recesses provided in the peripheral surface of the cylinder core on one and the other side of the key channel, the actuator acting upon the back of the stirrup.

Most cylinder locks have a cylinder housing with a cylinder sack containing the spring-loaded pins of the tumblers for scanning the edge of the flat key provided with the depressions.

Since the inventive locking cylinder is intended mainly for replacing these cylinder locks it preferably has the same form, i.e. likewise such a cylinder sack. According to the invention the cylinder sack of the cylinder housing preferably contains the actuator, the transponder reading unit and the power supply unit.

The cylinder locks in the doors of existing objects are generally formed as double cylinder locks with two cylinder cores. Between the two cylinder cores there is a locking bit which is connected, so as to rotate therewith, at least with the cylinder core which is just being turned with the key. Between its two halves the cylinder housing has a recess for the locking bit. The two cylinder cores can be interconnected so as to rotate with each other, or be rotatable relative to each other if a corresponding coupling is provided. In the latter case only one of the cylinder cores is preferably blocked and released by the blocking element, preferably the cylinder core on the outside of the door. The cylinder core on the inside of the door can then be unlocked with a key coded only mechanically.

Double cylinder locks are known whose two cylinder housing halves are connectable with a connecting piece to be inserted in a recess in the cylinder sack in one or the other cylinder housing half. Assembly of these double cylinder locks is especially simple. If the lock is formed as a double cylinder lock the two halves of the cylinder housing are therefore preferably likewise connectable with a connecting piece which engages in a recess in the cylinder sack of one or the other half of the cylinder housing.

According to the invention the key can be coded only electronically. However the electronic coding preferably constitutes a code in addition to the mechanical code of the flat key. That is, according to the invention the locking cylinder preferably has additional mechanical tumblers which scan the key so that the cylinder core is released if the tumblers are associated properly with the depressions of the key.

The electronic coding of the key then serves mainly as a personal code and additional security code to be recognized by the transponder reading device, so that if the electronic code matches that in the transponder reading device the blocking element releases the cylinder core, otherwise keeping it blocked.

The electronic coding thus considerably increases the lock safety. For example, if the personally coded key is lost or stolen the code can easily be changed in the memory of the transponder reading device. Also, with the electronic coding the lock operation can be released or blocked e.g. only at certain predetermined times or only for a certain period or certain periods.

The mechanical tumblers can consist, as usual, of a row of tumbler pins lying in bores in the cylinder core, and spring-loaded tumbler elements cooperating therewith in the cylinder housing. If the key is formed as a reversible flat key having rows of depressions to be associated with the tumbler pins on both narrow sides and both broadsides, three rows of tumblers are preferably provided, whereby the tumbler pins lying in the bores of the cylinder core for engaging in the depressions on the broadsides of the key are disposed on one and the other side of the key channel, and the tumbler pins lying in the bores of the cylinder core for engaging in the depressions on one of the narrow sides of the key are disposed in the key channel plane.

The transponder reading device can be provided with two ferrite antennas, one on the outside of the door and the other on the inside.

The key likewise preferably has a ferrite antenna. If it is formed as a reversible key two ferrite antennas are provided, one on one half of the key bow and the other on the other. Bores can be provided in the key bow for receiving the rod-shaped ferrite antennas.

The ferrite antennas are disposed in the locking cylinder and on the key in such a way that when the key is inserted in the locking cylinder there is only a narrow air gap between the ferrite antenna of the locking cylinder and the ferrite antenna of the key, so that only small energy losses occur during transfer.

The transponder reading device includes a microprocessor and a nonvolatile memory. Further, a clock is generally provided for the date and time function with a quartz oscillator as a time base. The actuator is driven directly by the micro-processor.

To ensure high protection from forgery and copying, the data traffic between the key and the locking cylinder can be encoded.

The transponder reading device is always ready for use. For energy-saving reasons, however, the processor is preferably put in a standby or sleep mode in which only the date and time function is activated. The processor is supplied with power or activated when the key is inserted in the locking cylinder. The processor is switched to this activated operating mode or read mode by a wake-up circuit.

In the activated operating mode, after the data are read into the memory and a safety decoding of the key performed if necessary, the user data of the key are read out of the memory. The read-in key data are checked with the stored data in the cylinder lock (e.g. customer number, locking system number, group number, key number). If the read-in data of the key do not match the stored data the blocking element remains blocked, while if they match the blocking element is unlocked by the actuator.

The unlocked state of the blocking element is maintained for a certain predetermined period of time, e.g. 5 s. If the key is not turned during this time the actuator is operated for locking the blocking element. That is, the key must then be inserted in the locking cylinder a second time if it is not turned after the predetermined period of time.

The transponder reading device can be woken up in different ways. The wake-up circuit can thus have a sensor, for example a piezoelectric element, which detects insertion of the key in the locking cylinder. The piezoelectric element can be subjected to pressure for example by the tumblers.

An inductive proximity sensor can also be provided. The resonant circuit of the transponder reading device can thus be detuned when the key itself approaches. The transponder reading device can emit pulses via the ferrite antenna at certain time intervals, e.g. of 1 s, the pulses being dampened when the key approaches and thus operating the wake-up circuit.

Further it is possible to provide the key with a permanent magnet whose magnetic field, when the key approaches the transponder reading device, induces a voltage pulse in the coil thereof, thereby operating the wake-up circuit.

The power supply device can be a replaceable battery or a rechargeable accumulator. The accumulator can be charged by solar cells. However the power supply device can also be charged by means of a high-frequency field to be coupled in via the ferrite antenna of the transponder reading device. One can thus dispense with contact pieces for charging the power supply device.

For charging the power supply device by means of a high-frequency field one can provide a power key with a ferrite antenna, so that the power is transferred via the narrow air gap between the ferrite antenna of the power key and the ferrite antenna of the transponder reading device. The power key has no lock function. It can be formed as an emergency opening key. That is, the power that it can transfer to the power supply device can be dimensioned so as to suffice only for one operation of the actuator, i.e. for one unlocking of the door.

The data are preferably stored in, and removed from, the memory of the transponder reading device by means of a field to be coupled in via the ferrite antenna of the transponder reading device.

The data of authorized keys can be stored with a programming key. Further an erase key can be provided for removing the stored data.

A programming device which is operated with a PC is preferably provided for transferring the data to the programming key and erase key. That is, the programming key and erase key serve as communication keys between the programming device and the transponder reading device.

The programming device serves at the same time to program the circuit (IC) contained in the key.

When the key is removed, i.e. the ferrite antenna of the key moves away from the ferrite antenna of the locking cylinder, the blocking element shifts the actuator to the blocked position. When the key inserted in the locking cylinder is turned, the ferrite antenna of the key likewise moves away from the ferrite antenna of the locking cylinder. That is, if no additional measures were taken the actuator would be operated upon turning of the locking cylinder; it would try to push the blocking element to the blocked position.

To prevent this, i.e. to leave the actuator unoperated upon turning of the key, one can provide a key contact sensor, for example a piezoelectric element or a switch for detecting a rotary position of the cylinder core. Since the blocking element is located in the release position during turning of the cylinder core, the switch is preferably designed so as to be operated by the blocking element when the latter is located in the release position.

To indicate a low state of charge or END-OF-LIFE state of the power supply unit, a special algorithm can be provided for unlocking the cylinder lock. This algorithm can be for example a time delay between insertion of the key in the locking cylinder and release of the cylinder core, or repeatedly necessary insertion of the key to open the lock.

The inventive locking device can also be used to perform double or multiple locking. That is, opening takes place only after insertion of two or more authorized keys, optionally in a certain order.

Attempts to open with unauthorized keys can be made more difficult if the time for an authorization test increases as the number of abortive attempts increases.

The power supply device is disposed in a compartment in the cylinder housing. This compartment can preferably be opened only if an authorized key is inserted in the lock. The compartment can be protected by the actuator.

BRIEF DESCRIPTION OF THE DRAWINGS

In the following an embodiment of the inventive locking device will be explained more closely with reference to the drawing, in which.

DETAILED DESCRIPTION

Figure 1:
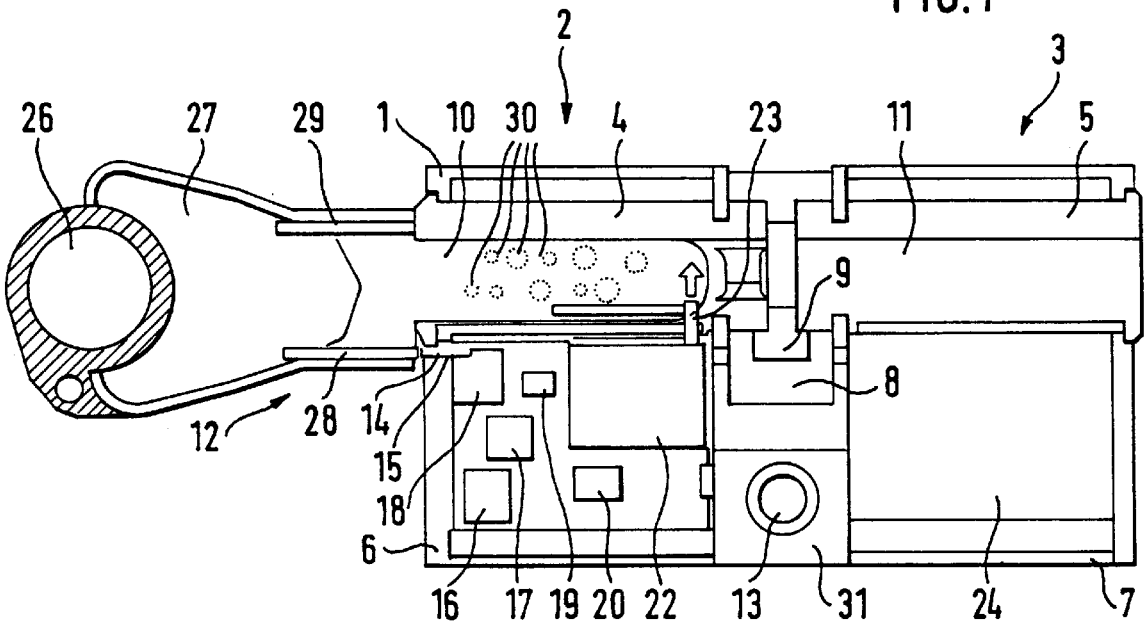
FIG. 1 schematically shows a longitudinal section through a locking cylinder of a double cylinder lock with the key inserted.

According to FIG. 1 a double cylinder lock has cylinder housing 1 with cylinder cores 4, 5 rotatably mounted in two halves 2, 3 respectively, of the housing.

Each cylinder housing half 2, 3 is provided with massive cylinder sack 6, 7. Between cylinder housing halves 2, 3 the cylinder housing has recess 8 for locking bit 9 which is disposed between cylinder cores 4, 5.

Locking bit 9 is connected by means of a coupling (not shown), so as to rotate therewith, with particular cylinder core 2, 3 which is being turned with key 12 inserted in key channel 10, 11 of cylinder core 4, 5.

Bore 13 in cylinder housing 1 serves to fasten the double cylinder lock with a screw (not shown) in the door lock.

As illustrated by the block diagram in FIG. 1, cylinder sack 6 contains ferrite antenna 14 which extends through corresponding bore 15 in the end wall of cylinder housing 1. A second ferrite antenna (not shown) can extend in the other cylinder sack 7 on the end wall thereof.

Antenna 14 is connected to a transponder reading device which consists substantially of microprocessor 16 and non-volatile memory 17. The transponder reading device further has analog section 18 as well as real-time clock 19 and quartz oscillator 20 as a time base.

Figure 2:
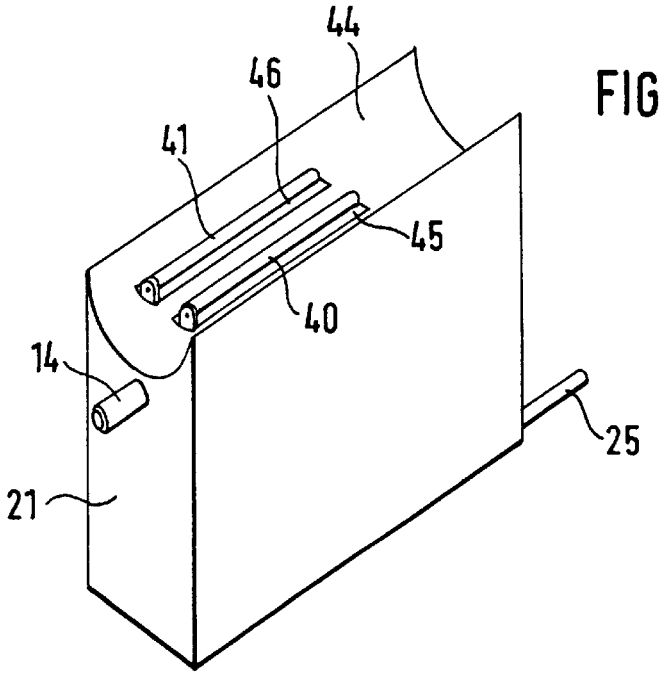
FIG. 2 shows an enlarged and schematic perspective view of a plug-in module with the transponder reading device and the actuator for the cylinder sack of the cylinder housing.

The transponder reading device, i.e. antenna 14, microprocessor 16, memory 17, analog section 18, real-time clock 19 and quartz oscillator 20 are disposed along with actuator 22 and blocking element 23 operated by actuator 22 in module 21 with a massive housing (FIG. 2). Module 21 is pushed into cylinder sack 6, from the side of cylinder housing half 2 facing the middle of cylinder housing 1. Ferrite antenna 14 protrudes from module 21 on an end wall.

Power supply device 24 is disposed in a compartment in cylinder sack 5 of other cylinder housing half 3. It can be pushed into the compartment in cylinder sack 7 from the side facing the middle of cylinder housing 1 (FIG. 1). Power supply device 24 is connected with module 21 by line 25 (FIG. 2).

Key 12 is provided on bow 27 with electronic module 26 which contains the data carrier. Key 12 formed as a transponder has two ferrite antennas 28, 29 for radiofrequency data transmission which are inserted in corresponding bores in the upper and lower halves of key bow 27.

Key 12 is provided on the broadside with depressions 30 to be engaged by the tumblers described below. Corresponding depressions are provided on the other broadside of the key not shown in FIG. 1 and on the two narrow sides of the key.

Figure 3:
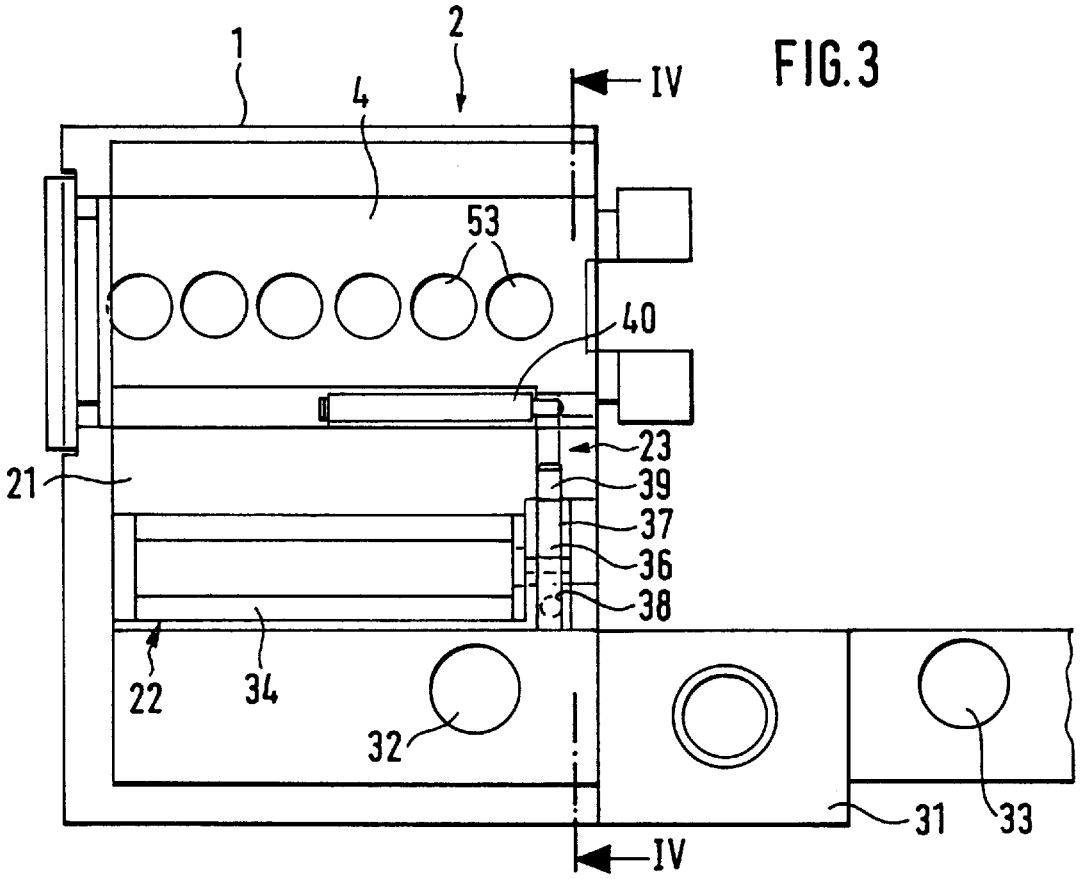
FIG. 3 shows a longitudinal section through one half of the double cylinder lock of FIG. 1 in an enlarged view, the electronics being omitted.
Figure 4:
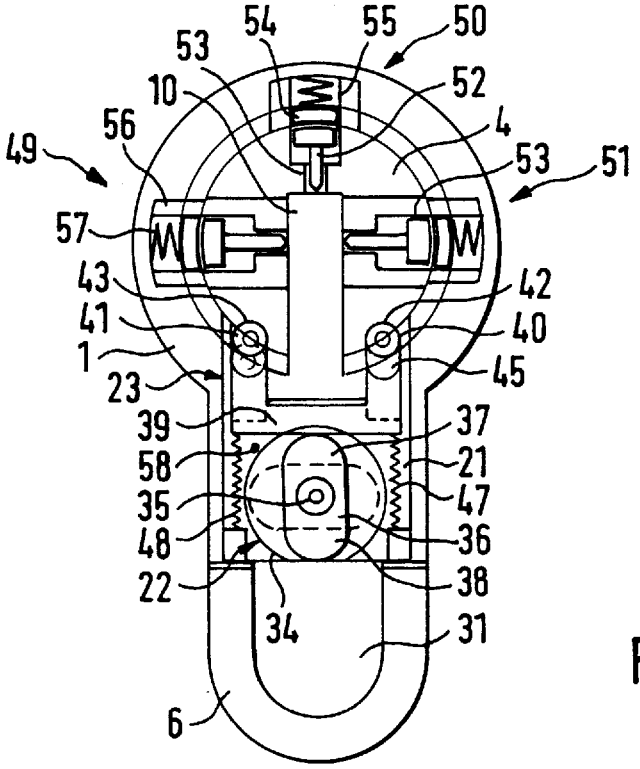
FIG. 4 shows a section along line IV—IV in FIG. 3.

As indicated by FIGS. 1, 3 and 4, halves 2, 3 of cylinder housing 1 of the double cylinder lock are interconnected by connecting piece 31 which is inserted with each end in a corresponding recess in the lower part of cylinder sack 6, 7, i.e. the one remote from cylinder core 4, 5, in one or the other half 2, 3. A cross pin in bores 32, 33 connects connecting piece 31 with cylinder housing halves 2, 3.

In the upper part of cylinder sack 6, i.e. the one facing cylinder core 4, module 21 is inserted with actuator 22, blocking element 23 and the electronics not shown in FIGS. 3 and 4.

Actuator 22 has minute electric motor 34 whose shaft 35 extends in the longitudinal direction of the cylinder core. Disposed on shaft 35 so as to rotate therewith is eccentric 36 which has two cams 37, 38 offset by 180°.

Eccentric 36 is used to shift blocking element 23 which blocks or releases cylinder core 4.

Blocking element 23 is formed by stirrup 39 having rolls 40, 41 rotatably mounted one on each end. Rolls 40, 41 engage in groove-shaped recesses 42, 43 on the cylinder core periphery which extend in the longitudinal direction of the cylinder core. Recesses 42, 43 have a radius of curvature corresponding to rolls 40, 41. The length of rolls 40, 41 corresponds to about half the length of cylinder core 4. Recesses 42, 43 on the cylinder core periphery are spaced from key channel 10, which is open downward, i.e. toward cylinder sack 6.

Stirrup 39 is displaceable radially to cylinder core 4 in a corresponding recess in module 21. The two ends of stirrup 39 with rolls 40, 41 protrude from upper surface 44 of module 21 which is curved concavely in accordance with cylinder core 4 (FIG. 2). Surface 44 of module 21 is provided for its part with slot- or groove-shaped recesses 45, 46 which receive rolls 40, 41 when blocking element 23 releases cylinder core 4 and cylinder core 4 is turned with key 12. The release position of stirrup 39 is indicated in FIG. 4 by the lower position of left-hand roll 41 shown by dashed lines.

Blocking element 23 or stirrup 39 is loaded by springs 47, 48 into the blocked position in which rolls 40, 41 engage in groove-shaped recesses 42, 43 on the periphery of cylinder core 4.

In the blocked position shown in FIGS. 3 and 4, cams 37, 38 of eccentric 36 act upon the side of stirrup 39 facing away from cylinder core 4 and upon the end of connecting piece 31 pushed into cylinder sack 6, respectively. This blocks stirrup 39 drawn into the blocked position by springs 47, 48.

When eccentric 36 is turned through 90° into the position shown by dashed lines in FIG. 4 it releases stirrup 39. Turning cylinder core 4 with key 12 urges rolls 40, 41 against the force of springs 47, 48 out of groove-shaped recesses 42, 43 into recesses 44, 45 in module 21, whereupon cylinder core 4 is freely rotatable.

The mechanical tumblers consist of three rows 49, 50, 51. Rows 49 and 51 are disposed on both sides of key channel 10, row 50 is located in the key channel plane on the side of cylinder core 4 facing away from cylinder sack 6.

Each row of tumblers 49, 50, 51 has tumbler pins 52 lying in bores 53 in cylinder core 4. Cooperating with tumbler pins 52 are pin- or plate-shaped tumbler elements 54 lying in bores 55, in strip 56 disposed in an inside recess in cylinder housing 1. Tumbler pins 54 are loaded with springs 57 toward cylinder core 4.

Tumbler pins 52 of tumblers 49 and 51 engage in depressions 30 in the two broadsides of key 12, tumbler pins 52 of tumblers 50 in the depressions on the narrow side of the key.

FIG. 4 shows contact 58. Contact 58 is operated when stirrup 39 releases cylinder core 4. Upon operation of contact 58 motor 34 remains unoperated even when key 12 is turned and ferrite antennas 14 and 28 (FIG. 1) thus moved away from each other.

The embodiment of the invention in which an exclusive property or privilege is claimed are defined as follows.

We claim:

1. A locking device including:

a key, said key including a data carrier containing identification data, a transmission member connected to said data carrier for broadcasting signals representative of the identification data and a shaft formed with depressions;

a cylinder housing;

a cylinder core rotatably mounted in said cylinder housing, said cylinder core having a key channel for receiving said shaft of said key and being formed with two recesses along an outer circumferential surface of said cylinder core, said recesses being located on opposed sides of said key channel;

a tumbler assembly disposed in said cylinder housing and said cylinder core for preventing rotation of said cylinder core, said tumbler assembly having a plurality of pins that are positioned to extend into said key channel wherein, when said pins are properly seated in said depressions of said shaft of said key, said tumbler assembly allows said cylinder core to rotate;

a blocking element disposed in said cylinder housing that is formed as a stirrup having two legs and a spring positioned to engage said blocking element so as to urge said legs into said recesses of said cylinder core so that when said blocking element is so engaged, said cylinder core is blocked from rotation, said blocking element and said spring being configured so that rotation of said cylinder core causes disengagement of said legs from said recesses;

an eccentric in said cylinder housing having a release position wherein said eccentric is spaced from said blocking element so as to allow said legs to disengage from said recesses of said cylinder core and a blocking position wherein said eccentric is positioned to abut said blocking element to prevent disengagement of said legs from said recesses of said cylinder core and the rotation of said cylinder core;

an actuator disposed in said cylinder housing and connected to said eccentric for moving said eccentric between said release position and said blocking position;

a transponder reading device in said cylinder housing for receiving the signals broadcast by said key and for controlling said actuator in response to the received signals, wherein if the received signals contain predefined identification data, said transponder reading device causes said actuator to move said eccentric from said blocking position to said release position; and a power supply device in said cylinder housing for energizing said actuator and said transponder reading device.

2. The locking device of claim 1, wherein said actuator is an electric motor.

3. The locking device of claim 1, wherein said transponder reading device has at least one ferrite antenna with a free end that extends from an outer end wall of said cylinder housing.

4. The locking device of claim 1, wherein said transponder reading device has a standby mode for energy-saving operation in the absence of said key being in said key channel and an activated operating mode for receiving the signals broadcast by said key when said key is inserted in said key channel and a wake-up circuit is provided for switching said transponder reading device from the standby mode to the activated operating mode and back to the standby mode.

5. The locking device of claim 1, further including a roll body rotatably attached to each leg of said stirrup, said roll bodies being positioned to engage said recesses of said cylinder core.

6. A locking device including:

a key, said key including a data carrier containing identification data, a transmission member connected to said data carrier for broadcasting signals representative of the identification data and a shaft formed with depressions;

a cylinder housing;

a cylinder core rotatably mounted in said cylinder housing, said cylinder core having a key channel for receiving said shaft of said key and being formed with a recess along an outer circumferential surface thereof;

a tumbler assembly disposed in said cylinder housing and said cylinder core for preventing rotation of said cylinder core, said tumbler assembly having a plurality of pins that are positioned to extend into said key channel wherein, when said pins are properly seated in said depressions of said shaft of said key, said tumbler assembly allows said cylinder core to rotate;

a blocking element disposed in said cylinder housing that is positioned to engage in said recess formed in said cylinder core and a spring positioned to engage said blocking element so as to urge said blocking element into said recess so that when said blocking element is so engaged, said cylinder core is blocked from rotation, said blocking element and said spring being configured so that rotation of said cylinder core causes disengagement of said blocking element from said recess;

an eccentric in said cylinder housing having a release position wherein said eccentric is spaced from said blocking element so as to allow said blocking element to disengage from said recess of said cylinder core and a blocking position wherein said eccentric is positioned to abut said blocking element to prevent disengagement of said blocking element from said recess of said cylinder core and the rotation of said cylinder core;

an actuator disposed in said cylinder housing and connected to said eccentric for moving said eccentric between said release position and said blocking position;

a transponder reading device in said cylinder housing for receiving the signals broadcast by said key and for controlling said actuator in response to the received signals, said transponder having a ferrite antenna through which the signals broadcast by said key are received wherein, if the received signals contain predefined identification data, said transponder reading device causes said actuator to move said eccentric from said blocking position to said release position, and data is stored within said transponder reading device and is removed from said transponder reading device by means of a field exposed to said antenna; and a power supply device in said cylinder housing for energizing said actuator and said transponder reading device.

7. The locking device of claim 6, wherein a separate key is provided for storing or removing the data to and from said transponder reading device.

8. The locking device of claim 6, wherein said blocking element has a rigid member and a roll body that is rotatably attached to said rigid member for engaging in said recess of said cylinder core.

9. The locking device of claim 6, wherein: said cylinder core is formed to have two recesses in said circumferential surface located on opposed sides of said key channel; and said blocking element is formed as a stirrup having two opposed legs, each leg engaging a separate one of said recesses in said cylinder core.

10. A locking device including:

a key, said key including a data carrier containing identification data, a transmission member connected to said data carrier for broadcasting signals representative of the identification data and a shaft formed with depressions;

a cylinder housing;

a cylinder core rotatably mounted in said cylinder housing, said cylinder core having a key channel for receiving said shaft of said key and being formed with a recess along an outer circumferential surface thereof;

a tumbler assembly disposed in said cylinder housing and said cylinder core for preventing rotation of said cylinder core, said tumbler assembly having a plurality of pins that are positioned to extend into said key channel wherein, when said pins are properly seated in said depressions of said shaft of said key, said tumbler assembly allows said cylinder core to rotate;

a blocking element disposed in said cylinder housing, said blocking element having a rigid member and a roll body that is rotatably attached to said rigid member and that is positioned to engage said recess formed in said cylinder core and a spring positioned to engage said blocking element so as to urge said roll body into said recess so that when said blocking element is so engaged, said cylinder core is blocked from rotation, said blocking element and said spring being configured so that rotation of said cylinder core causes disengagement of said roll body from said recess;

an eccentric in said cylinder housing having a release position wherein said eccentric is spaced from said blocking element so as to allow said roll body of blocking element to disengage from said recess of said cylinder core and a blocking position wherein said eccentric is positioned to abut said blocking element to prevent disengagement of said roll body from said recess of said cylinder core and the rotation of said cylinder core;

an actuator disposed in said cylinder housing and connected to said eccentric for moving said eccentric between said release position and said blocking position;

a transponder reading device in said cylinder housing for receiving the signals broadcast by said key and for controlling said actuator in response to the received signals wherein, if the received signals contain predefined identification data, said transponder reading device causes said actuator to move said eccentric from said blocking position to said release position; and a power supply device in said cylinder housing for energizing said actuator and said transponder reading device.

11. The locking device of claim 10, wherein said transponder reading device has at least one ferrite antenna with a free end that extends from an outer end wall of said cylinder housing.

12. The locking device of claim 10, wherein said actuator is configured to not operate upon rotation of said cylinder core from a locked state.

13. The locking device of claim 10, wherein said actuator is an electric motor.

14. The locking device of claim 10, wherein said transponder reading device has a standby mode for energy-saving operation in the absence of said key being in said key channel and an activated operating mode for receiving the signals broadcast by said key when said key is inserted in said key channel and a wake-up circuit is provided for switching said transponder reading device from the standby mode to the activated operating mode and back to the standby mode.

15. A locking device including:

a key, said key including a data carrier containing identification data, a transmission member connected to said data carrier for broadcasting signals representative of the identification data and a shaft formed with depressions;

a cylinder housing;

a cylinder core rotatably mounted in said cylinder housing, said cylinder core having a key channel for receiving said shaft of said key and being formed with a recess along an outer circumferential surface thereof;

a tumbler assembly disposed in said cylinder housing and said cylinder core for preventing rotation of said cylinder core, said tumbler assembly having a plurality of pins that are positioned to extend into said key channel wherein, when said pins are properly seated in said depressions of said shaft of said key, said tumbler assembly allows said cylinder core to rotate;

a blocking element disposed in said cylinder housing that is positioned to engage said recess formed in said cylinder core and a spring positioned to engage said blocking element so as to urge said blocking element into said recess so that when said blocking element is so engaged, said cylinder core is blocked from rotation, said blocking element and said spring being configured so that rotation of said cylinder core causes disengagement of said blocking element from said recess;

an eccentric in said cylinder housing, said eccentric having two opposed cams, said eccentric having a release position wherein said eccentric is spaced from said blocking element so as to allow said blocking element to disengage from said recess of said cylinder core and a blocking position wherein a first said cam abuts said blocking element and a second said cam abuts a portion of said cylinder housing to prevent disengagement of said blocking element from said recess of said cylinder core and the rotation of said cylinder core;

an actuator disposed in said cylinder housing and connected to said eccentric for moving said eccentric between said release position and said blocking position;

a transponder reading device in said cylinder housing for receiving the signals broadcast by said key and for controlling said actuator in response to the received signals wherein, if the received signals contain predefined identification data, said transponder reading device causes said actuator to move said eccentric from said blocking position to said release position; and a power supply device in said cylinder housing for energizing said actuator and said transponder reading device.

16. The locking device of claim 15, wherein said blocking element has a rigid member and a roll body that is rotatably attached to said rigid member for engaging in said recess of said cylinder core.

17. The locking device of claims 15, wherein: said cylinder core is formed to have two recesses in said circumferential surface located on opposed sides of said key channel; and said blocking element is formed as a stirrup having two opposed legs, each leg engaging into a separate one of said recesses in said cylinder core.

18. The locking device of claim 15, wherein said transponder reading device has at least one ferrite antenna with a free end that extends from an outer end wall of said cylinder housing.

19. A locking device including:

a key, said key including a data carrier containing identification data, a transmission member connected to said data carrier for broadcasting signals representative of the identification data and a shaft formed with depressions;

a cylinder housing;

a cylinder core rotatably mounted in said cylinder housing, said cylinder core having a key channel for receiving said shaft of said key and being formed with a recess along an outer circumferential surface thereof;

a tumbler assembly disposed in said cylinder housing and said cylinder core for preventing rotation of said cylinder core, said tumbler assembly having a plurality of pins that are positioned to extend into said key channel wherein, when said pins are properly seated in said depressions of said shaft of said key, said tumbler assembly allows said cylinder core to rotate;

a blocking element disposed in said cylinder housing that is positioned to engage said recess formed in said cylinder core and a spring positioned to engage said blocking element so as to urge said blocking element into said recess so that when said blocking element is so engaged, said cylinder core is blocked from rotation, said blocking element and said spring being configured so that rotation of said cylinder core causes disengagement of said blocking element from said recess;

an eccentric in said cylinder housing having a release position wherein said eccentric is spaced from said blocking element so as to allow said blocking element to disengage from said recess of said cylinder core and a blocking position wherein said eccentric is positioned to abut said blocking element to prevent disengagement of said blocking element from said recess of said cylinder core and the rotation of said cylinder core;

an actuator disposed in said cylinder housing and connected to said eccentric for moving said eccentric between said release position and said blocking position;

a transponder reading device in said cylinder housing for receiving the signals broadcast by said key and for controlling said actuator in response to the received signals wherein, if the received signals contain predefined identification data, said transponder reading device causes said actuator to move said eccentric from said blocking position to said release position; and a power supply device in said cylinder housing for energizing said actuator and said transponder reading device, wherein said transponder reading device is further configured to monitor the charge level of said power supply device and, when said transponder reading device determines that said power supply device has a low charge level, said transponder reading device executes specific process steps to cause a message to be generated indicting the low charge level of said power supply device.

20. The locking device of claim 19, wherein when said transponder reading device determines that said power supply device has a low charge level, said transponder reading device delays actuation of said actuator after insertion of said key or requires said key to be inserted in said key channel a plurality of times in order to effect actuation of said actuator.

21. The locking device of claim 19, wherein said blocking element has a rigid member and a roll body that is rotatably attached to said rigid member for engaging into said recess of said cylinder core.

22. The locking device of claim 19, wherein: said cylinder core is formed to have two recesses in said circumferential surface located on opposed sides of said key channel; and said blocking element is formed as a stirrup having two opposed legs, each leg engaging into a separate one of said recesses in said cylinder core.

23. The locking device of claim 19, wherein said transponder reading device has at least one ferrite antenna with a free end that extends from an outer end wall of said cylinder housing.

24. The locking device of claim 19, wherein said actuator is configured to not operate upon rotation of said cylinder core from a locked state.

25. A locking device including:

a key, said key including a data carrier containing identification data, a transmission member connected to said data carrier for broadcasting signals representative of the identification data and a shaft formed with depressions;

a cylinder housing;

a cylinder core rotatably mounted in said cylinder housing, said cylinder core having a key channel for receiving said shaft of said key and being formed with a recess along an outer circumferential surface thereof;

a key-state sensor for indicating if said key is inserted in said key channel;

a tumbler assembly disposed in said cylinder housing and said cylinder core for preventing rotation of said cylinder core, said tumbler assembly having a plurality of pins that are positioned to extend into said key channel wherein, when said pins are properly seated in said depressions of said shaft of said key, said tumbler assembly allows said cylinder core to rotate;

a blocking element disposed in said cylinder housing that is positioned to engage said recess formed in said cylinder core and a spring positioned to engage said blocking element so as to urge said blocking element into said recess so that when said blocking element is so engaged, said cylinder core is blocked from rotation, said blocking element and said spring being configured so that rotation of said cylinder core causes disengagement of said blocking element from said recess;

an eccentric in said cylinder housing having a release position wherein said eccentric is spaced from said blocking element so as to allow said blocking element to disengage from said recess of said cylinder core and a blocking position wherein said eccentric is positioned to abut said blocking element to prevent disengagement of said blocking element from said recess of said cylinder core and the rotation of said cylinder core;

an actuator disposed in said cylinder housing and connected to said eccentric for moving said eccentric between said release position and said blocking position;

a transponder reading device in said cylinder housing for receiving the signals broadcast by said key and for controlling said actuator in response to the received signals and that is connected to said key-state sensor for receiving a signal indicative of said key being inserted in said key channel, wherein said transponder reading device is configured to: delay receiving signals from said key for a select delay period of time after receiving the signal from said key-state sensor that said key is inserted in said key channel; if the received signals from said key contain predefined identification data, cause said actuator to move said eccentric from said blocking position to said release position; maintain a count of the number of said keys inserted in said key channel that do not broadcast signals containing the predefined identification data; and, if a select number of said keys are inserted in said key channel that do not broadcast the predefined identification data, to increase the time of the delay period between when a key is inserted into said key channel and when the signals broadcast by said key are received; and a power supply device in said cylinder housing for energizing said actuator and said transponder reading device.

26. The locking device of claim 25, wherein said blocking element has a rigid member and a roll body that is rotatably attached to said rigid member for engaging into said recess of said cylinder core.

27. The locking device of claim 26, wherein said transponder reading device has at least one ferrite antenna with a free end that extends from an outer end wall of said cylinder housing.

28. The locking device of claim 26, wherein said transponder reading device has a standby mode for energy-saving operation in the absence of said key being in said key channel and an activated operating mode for receiving the signals broadcast by said key when said key is inserted in said key channel and a wake-up circuit is provided for switching said transponder reading device from the standby mode to the activated operating mode and back to the standby mode.

29. The locking device of claim 26, wherein said actuator is configured to not operate upon rotation of said cylinder core from a locked state.

30. The locking device of claim 25, wherein: said cylinder core is formed to have two recesses in said circumferential surface located on opposed sides of said key channel; and said blocking element is formed as a stirrup having two opposed legs, each leg engaging into a separate one of said recesses in said cylinder core.

* * * * *